US010563946B2

(12) United States Patent
Couie

(10) Patent No.: US 10,563,946 B2
(45) Date of Patent: Feb. 18, 2020

(54) INVERTED PISTOL TABLE STAND SYSTEM AND DEVICE

(71) Applicant: William Christopher Couie, Vidalia, LA (US)

(72) Inventor: William Christopher Couie, Vidalia, LA (US)

( * ) Notice: Subject to any disclaimer, the term of this patent is extended or adjusted under 35 U.S.C. 154(b) by 8 days.

(21) Appl. No.: 15/939,663

(22) Filed: Mar. 29, 2018

(65) Prior Publication Data

US 2019/0072357 A1 Mar. 7, 2019

Related U.S. Application Data

(63) Continuation-in-part of application No. 15/698,454, filed on Sep. 7, 2017, now abandoned.

(51) Int. Cl.
*F41A 23/18* (2006.01)
*A47B 81/00* (2006.01)

(52) U.S. Cl.
CPC ..... *F41A 23/18* (2013.01); *A47B 81/005* (2013.01)

(58) Field of Classification Search
CPC ..... F41A 23/18
USPC ..... 42/94
See application file for complete search history.

(56) References Cited

U.S. PATENT DOCUMENTS

2012/0005937 A1* 1/2012 Milino ..... F41A 23/18 42/108
2019/0072357 A1* 3/2019 Couie ..... F41A 23/18

OTHER PUBLICATIONS

Thingiverse.com listing by user bobsavenger, "Handgun Stand and Magazine Holder", published Apr. 22, 2016 (Year: 2016).*

* cited by examiner

*Primary Examiner* — Samir Abdosh
(74) *Attorney, Agent, or Firm* — Olav M. Underdal; IDP Patent Services

(57) ABSTRACT

A pistol table stand system includes a pistol; a pistol table stand, including a bottom plate, and a pistol holder, including a holder protrusion that matches an ejection port of a pistol, and right and left side-flanges; such that the pistol can be positioned on the pistol holder in an inverted position between the right and left side-flanges.

17 Claims, 10 Drawing Sheets

Pistol Table Stand System

Pistol Table Stand System

Pistol Table Stand

INVERTED PISTOL TABLE STAND SYSTEM AND DEVICE

CROSS-REFERENCE TO RELATED APPLICATIONS

This application is a continuation-in-part of U.S. Non-Provisional application Ser. No. 15/698,454, filed Sep. 7, 2017, which is hereby included herein by reference in it's entirety.

FIELD OF THE INVENTION

The present invention relates generally to the field of firearm stands, and more particularly to devices, methods, and systems for organizing or storing a firearm with one or more firearm magazines.

BACKGROUND OF THE INVENTION

Use of semi-automatic pistols for practice at a pistol range often requires organization of multiple pistols along with the relevant ammunition, typically loaded in pistol magazines that are specific to each make and model of pistol.

When practicing with multiple pistols of different makes and models, this can create an unwanted level of disorganization, when all the different pistols and pistol magazines are laid out on a table in front of the person practicing on the pistol range.

Additionally, inserting and extracting a magazine normally requires two-handed operation, and can therefore be difficult for someone with a physical disability.

As such, considering the foregoing, it may be appreciated that there continues to be a need for novel and improved devices and methods for storing and organizing pistols and magazines at a firing range.

SUMMARY OF THE INVENTION

The foregoing needs are met, to a great extent, by the present invention, wherein in aspects of this invention, enhancements are provided to the existing model of storing and organizing pistols and magazines.

In an aspect, a pistol table stand system can include:

a) a pistol, comprising an ejection port; and b) a pistol table stand, which can include:

- a bottom plate; and
- a pistol holder, which can include:
  - a right side-flange, which is connected to an upper side of the bottom plate, such that the right side-flange protrudes upwards from the bottom plate;
  - a left side-flange which is connected to the upper side of the bottom plate, such that the left side-flange is parallel to the right side-flange, such that the left side-flange protrudes upwards from the bottom plate; and
  - a holder protrusion, which is connected to an upper side of the bottom plate, such that the holder protrusion protrudes upwards from the bottom plate;

wherein the holder protrusion can be positioned between the right and left side-flanges;

wherein an opening between the right and left side-flanges can be configured to accept the pistol in the inverted position, such that the pistol can be stably supported in the inverted position;

wherein the holder protrusion can be configured to accept the ejection port, when the pistol is positioned in an inverted position in the pistol table stand;

whereby the pistol table stand can be configured to hold the pistol in the inverted position.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1A:
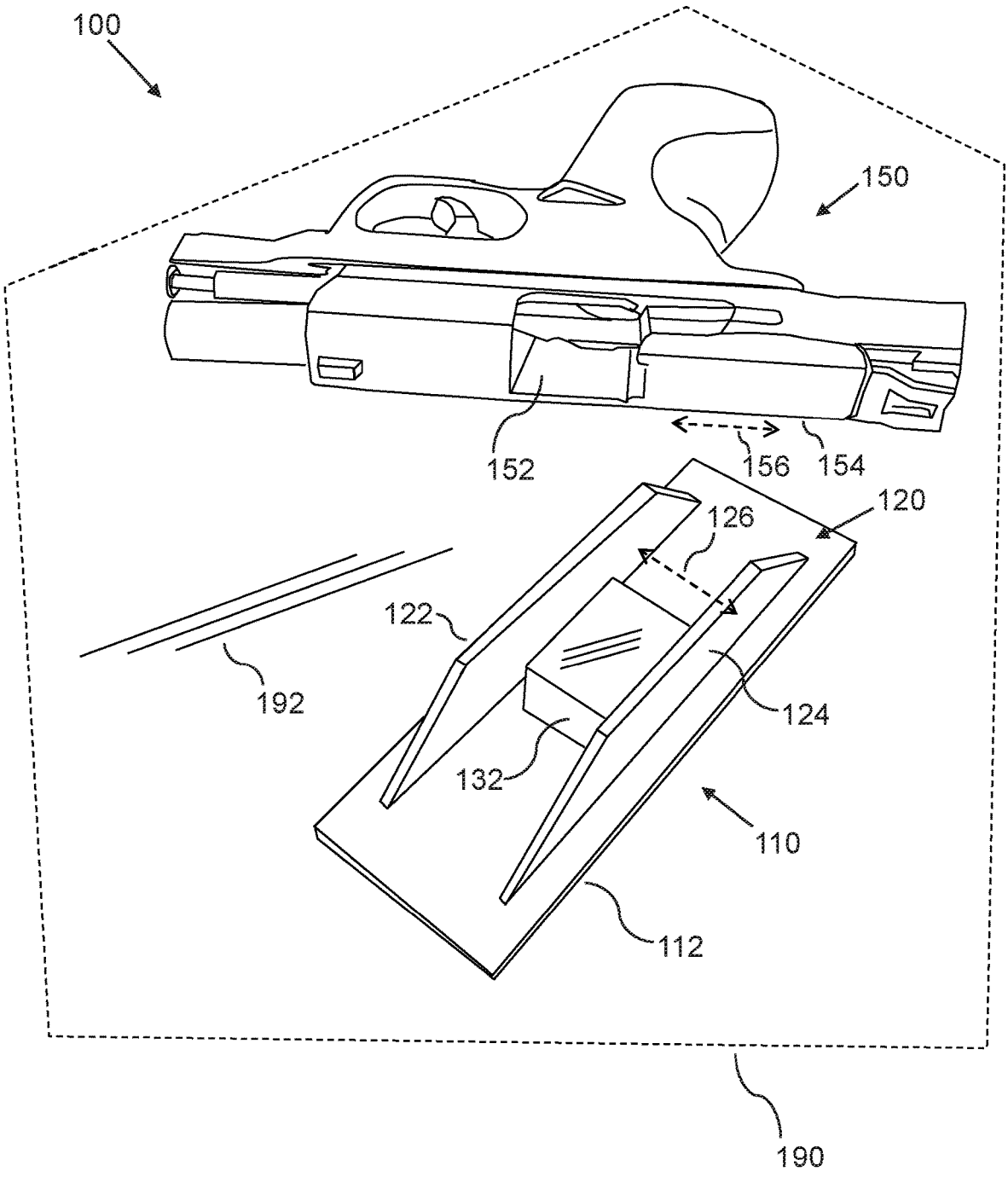
FIG. 1A is a perspective view of a pistol table stand system in a disassembled state, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a pistol table stand system 100 with reference to FIGS. 1A and 1B, in such manner that like reference numerals refer to like components throughout; a convention that we shall employ for the remainder of this specification.

Figure 1B:
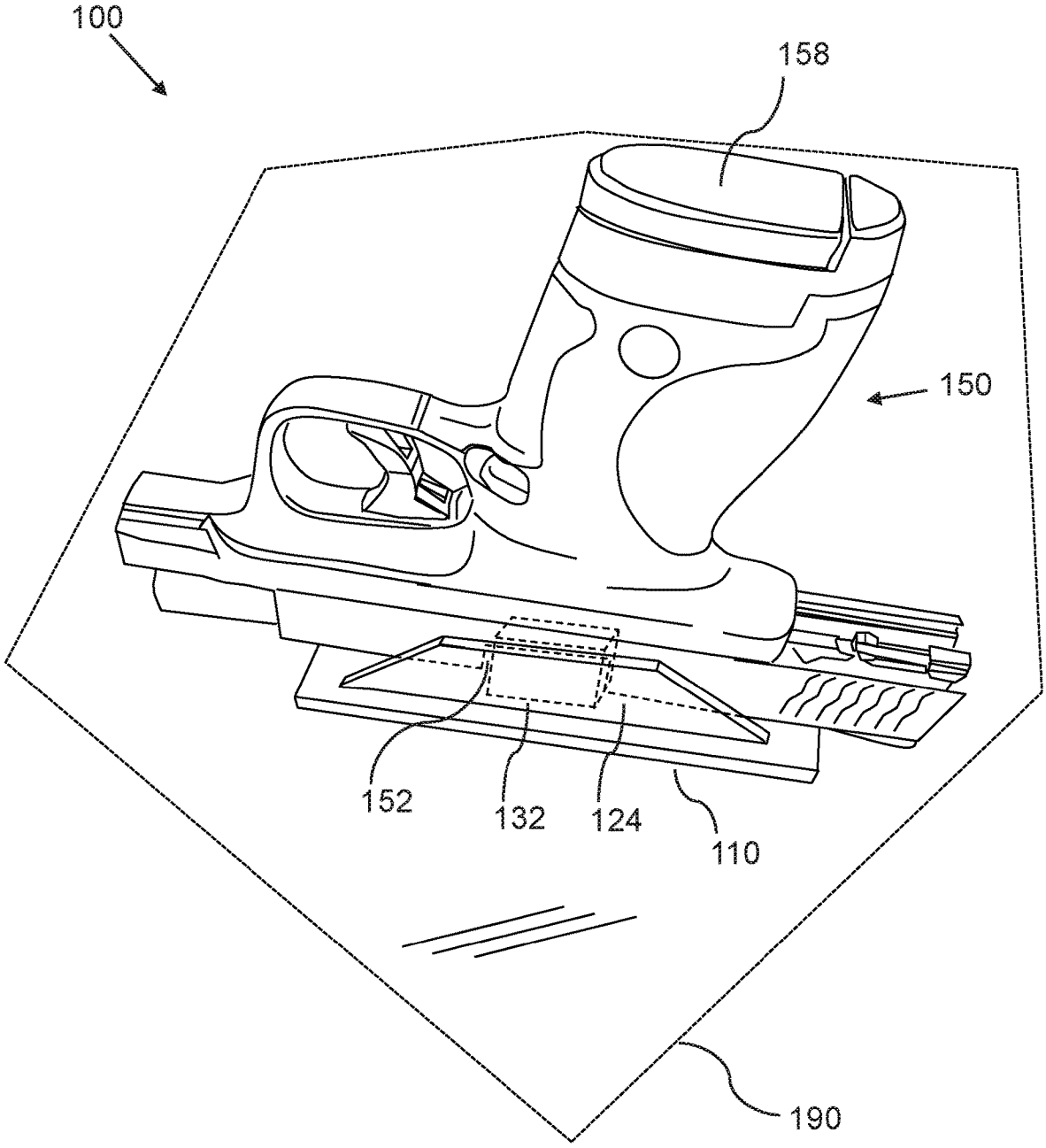
FIG. 1B is a perspective view of a pistol table stand system in an assembled state, according to an embodiment of the invention.

In an embodiment, as shown in FIGS. 1A and 1B, a pistol table stand system 100 can include:

a) a pistol 150, including an ejection port 152; and b) A pistol table stand 110, including:

i. a bottom plate 112;

ii. a pistol holder 120, which can include:

a right side-flange 122, which is connected to an upper side of the bottom plate 112, such that the right side-flange 122 protrudes upwards from the bottom plate 112;

a left side-flange 124 which is connected to the upper side of the bottom plate 112, parallel to the right side-flange 122, such that the left side-flange 124 protrudes upwards from the bottom plate 112; and a holder protrusion 132, which is connected to the upper side of the bottom plate 112, and positioned between the right and left side-flanges 122 124, such that the holder protrusion 132 protrudes upwards from the bottom plate 112;

wherein the holder protrusion 132 is configured to match with the ejection port 152, such that the holder protrusion 132 can be removably inserted into ejection port 152, such that that the holder protrusion 132 is configured to accept the ejection port 152, such that the holder protrusion 132 protrudes into the ejection port 152, when the pistol 150 is positioned in an inverted/upside down position in the pistol table stand 110, as shown in FIG. 1B, showing the inside/non-visible structures in dotted lines;

wherein an opening 126 (also referred to as a space/void 126) between the right and left side-flanges 122 124 is configured to accept the pistol in the inverted position, such that the pistol is secured and stably supported in the inverted position;

such that the pistol 150 can be removably positioned on the at least one pistol holder 120, as shown in FIG. 1B;

such that the pistol table stand is configured to be positioned on a flat surface 192, such as a table 190;

whereby the pistol table stand is configured to hold the at least one pistol in an inverted/upside down position, as shown in FIG. 1B;

whereby the inverted/upside position of the pistol 150 can facilitate one-handed inserting and extraction of a pistol magazine 158.

In related embodiments, the pistol table stand 110 can thereby be used to hold and organize the at least one pistol 150, for example for use:

a) at a firing range, such that the pistol table stand system 100 is positioned on a table 190 at the firing range;

b) for storage; or c) for display purposes, for example in a retail or home environment.

In another related embodiment, the pistol 150 can further include a pistol slide 154, such that the holder protrusion 132 can be configured to block a sliding movement 156 of the pistol slide 154, when the pistol 150 is positioned in an inverted/upside down position in the pistol table stand 110, whereby the holder protrusion 132 functions as a safety feature.

In a related embodiment, the holder protrusion 132 can be configured with a shape that matches the ejection port 152 of the pistol 150.

In a related embodiment, the holder protrusion 132 can be box-shaped with polygonal sides.

Figure 2A:
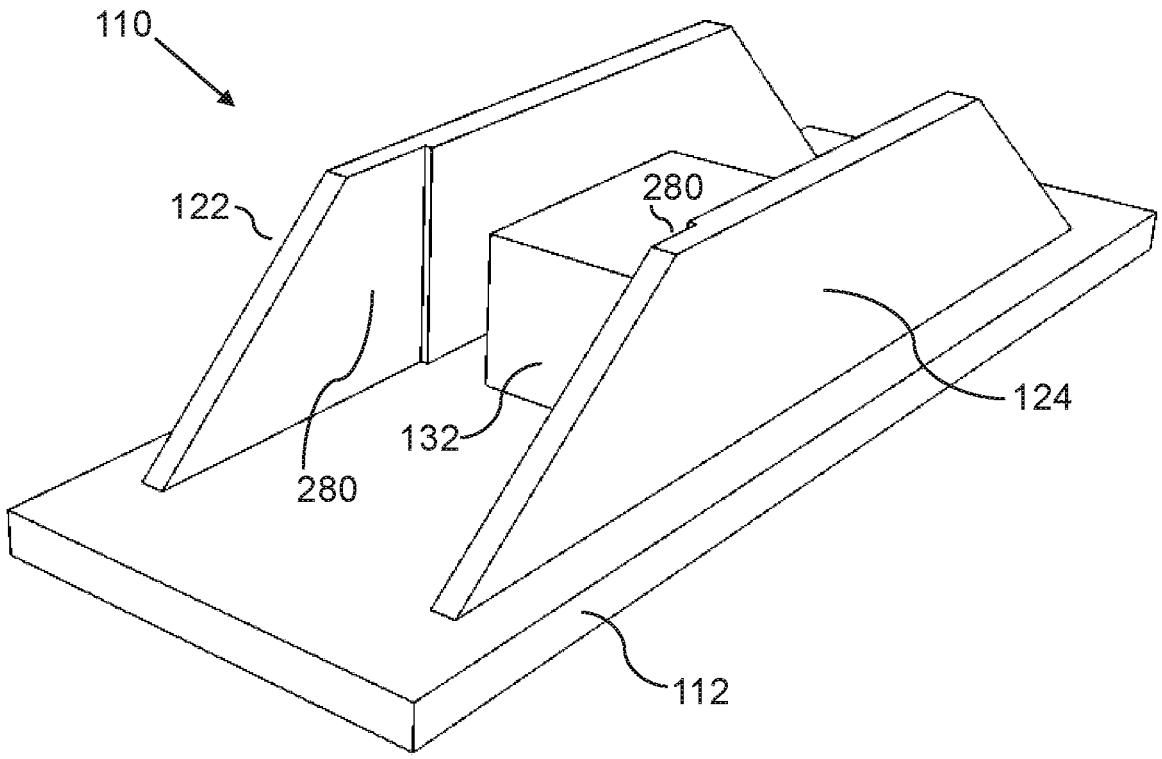
FIG. 2A is a front perspective view of a pistol table stand, according to an embodiment of the invention.
Figure 2B:
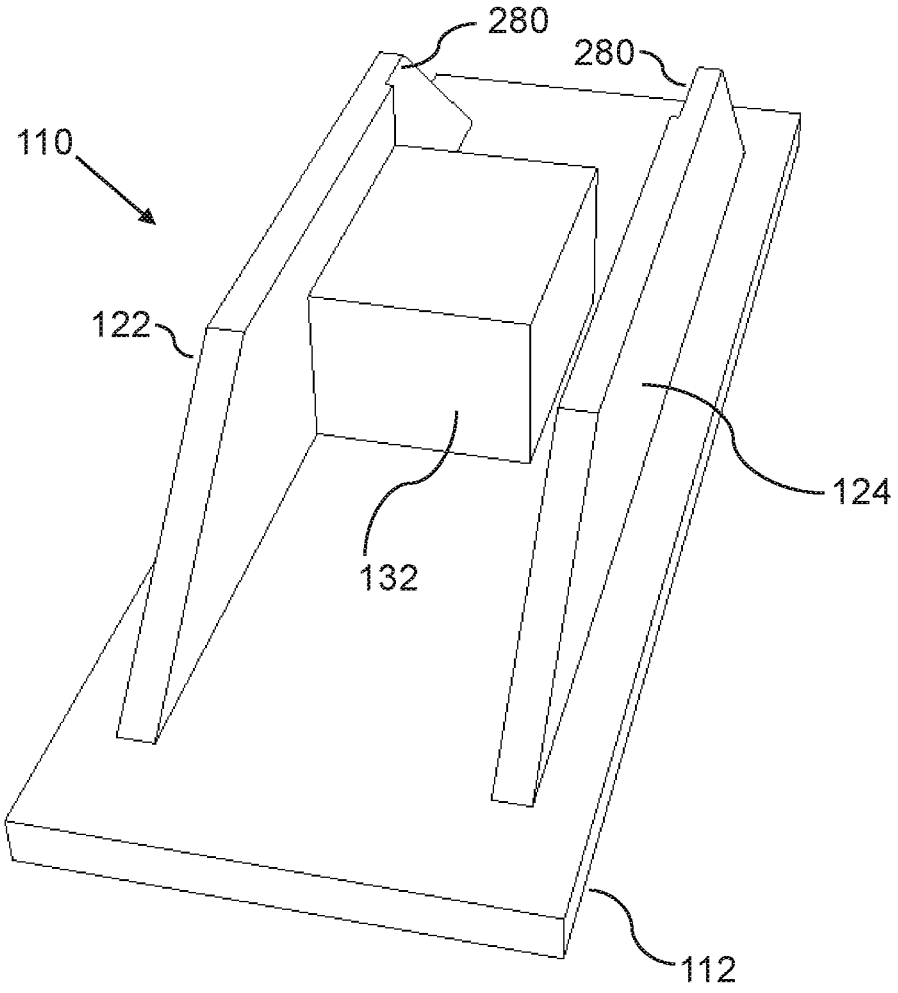
FIG. 2B is a rear perspective view of a pistol table stand, according to an embodiment of the invention.
Figure 2C:
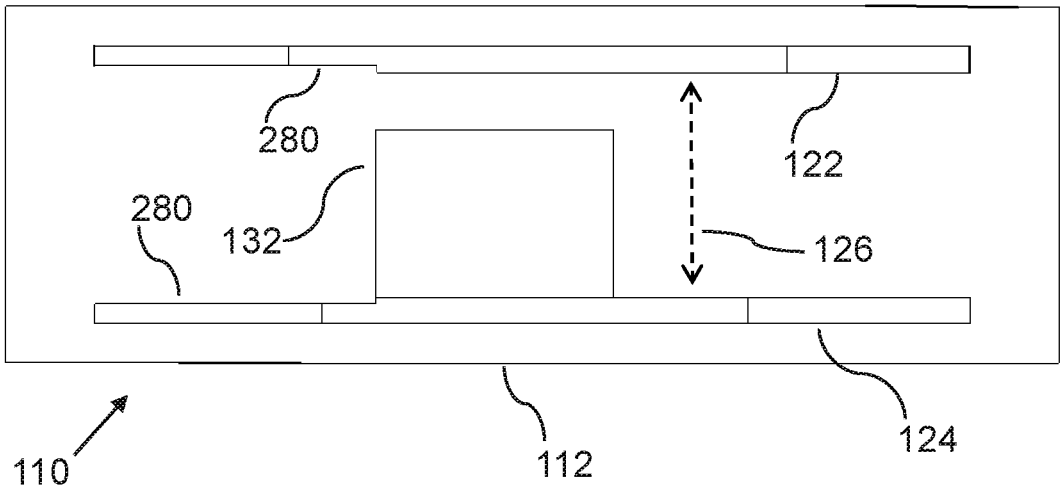
FIG. 2C is a top view of a pistol table stand, according to an embodiment of the invention.
Figure 2D:
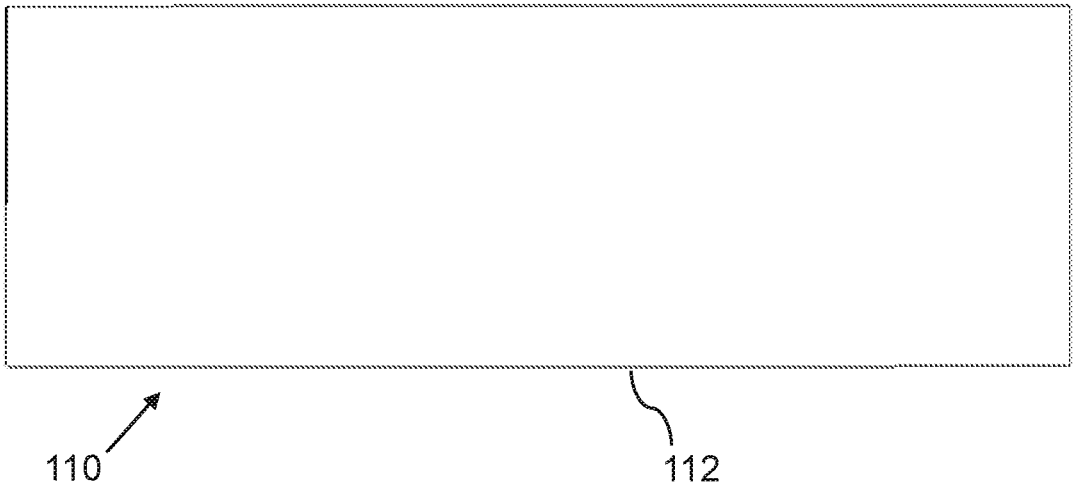
FIG. 2D is a bottom view of a pistol table stand, according to an embodiment of the invention.
Figure 2E:
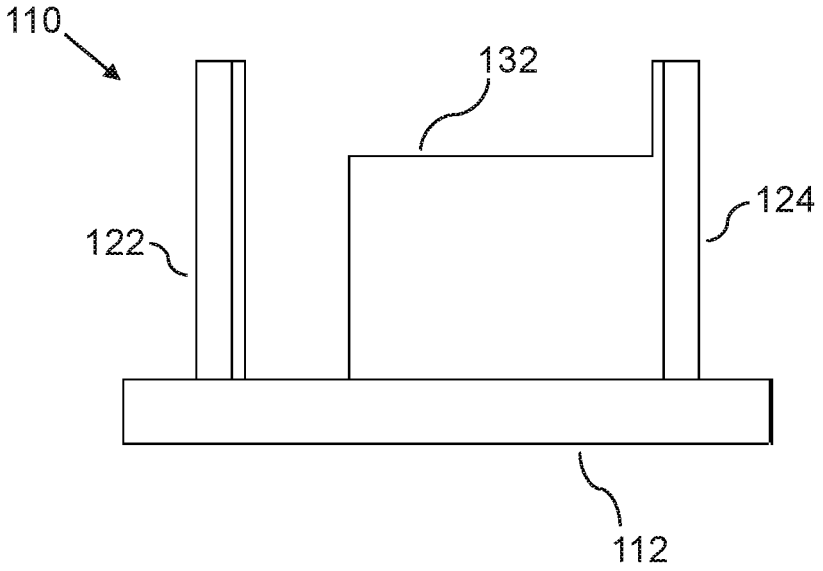
FIG. 2E is a front view of a pistol table stand, according to an embodiment of the invention.
Figure 2F:
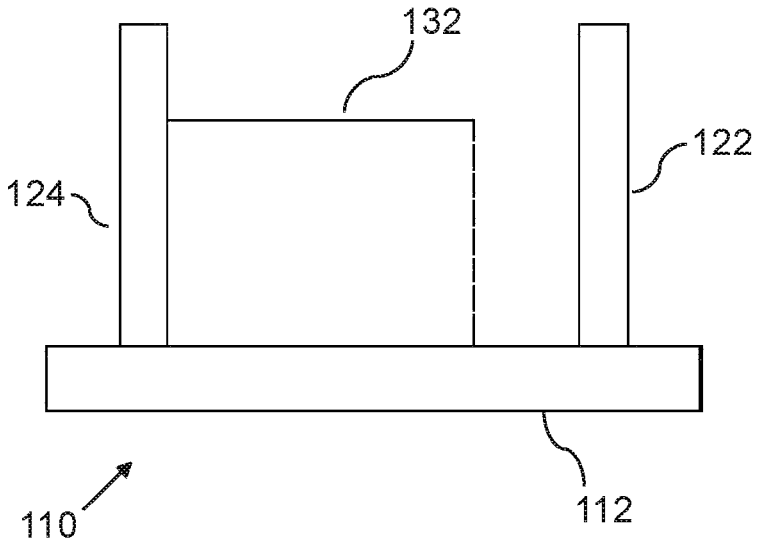
FIG. 2F is a rear view of a pistol table stand, according to an embodiment of the invention.
Figure 2G:
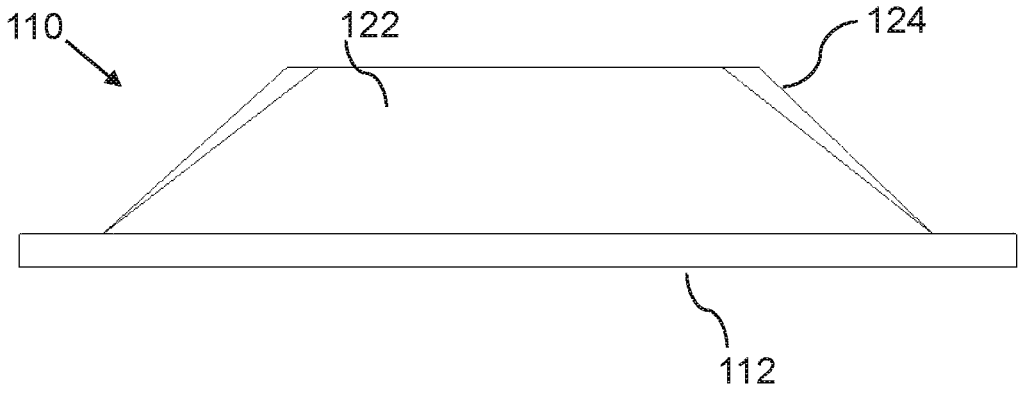
FIG. 2G is a right side view of a pistol table stand, according to an embodiment of the invention.
Figure 2H:
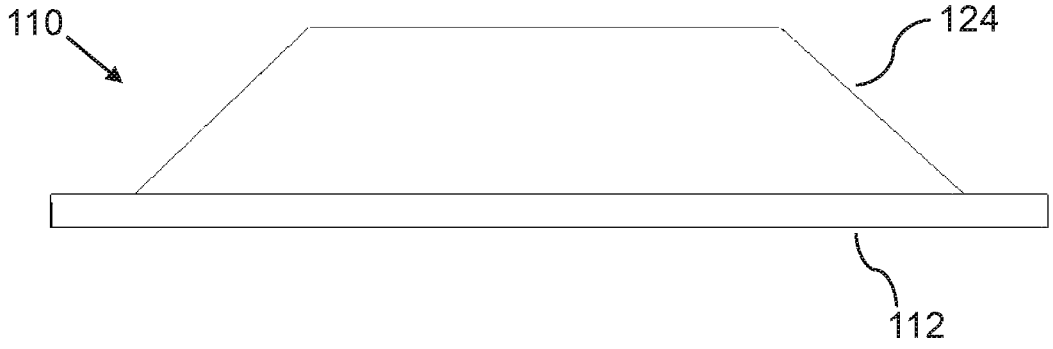
FIG. 2H is a left side view of a pistol table stand, according to an embodiment of the invention.

In a related embodiment, the right and left side-flanges 122 124 can be configured with a trapezoidal shape, as seen in a side view, such as shown in FIGS. 2G and 2H.

In a related embodiment, the holder protrusion 132 can be configured with a shape that is similar to an inner portion of the ejection port 152, such that the ejection port 152 slides onto and is secured on the holder protrusion 132, such that the pistol 150 is secured in place between the right and left side-flanges 122 124.

In another related embodiment, as shown in FIGS. 2A, 2B, and 2C, the right and left side-flanges 122 124 can each be configured with an indentation/recess 280 on inner sides of the right and left side-flanges 122 124, to match a shape of outer sides of the pistol 150. The presence of one or more indentations 280 on the inner sides depends on the shape of outer sides of the pistol 150. In some cases, the inner sides may be entirely flat/flush.

In some embodiments, as shown in FIG. 2G, the right and left side-flanges 122 124 can each be configured with different height, length, and/or shape, to match a shape of outer sides of the pistol 150. Such differences depend on and are configured to match the shape of outer sides of the pistol 150. In other embodiments, the right and left side-flanges 122 124 can be entirely similar, such that FIG. 2H show both right and left side views of the pistol table stand 110.

In yet another related embodiment, as shown in FIGS. 2B and 2C, the holder protrusion 132 can be in contact with/connected to at least one of the right and left side-flanges 122 124. In FIGS. 2B and 2C, the holder protrusion 132 is shown in contact with/connected to the left side-flange 124.

In a related embodiment, the pistol table stand 110 can be manufactured as one piece, for example by injection molding or by additive manufacturing, such as fused deposition modeling. Alternatively, the pistol table stand 110 can be assembled from separate pieces that are for example glued or fused together. The pistol table stand 110 can be made of a plastic material, or other suitable materials, such as metal, including rubber or plastic-coated metal.

Figure 3:
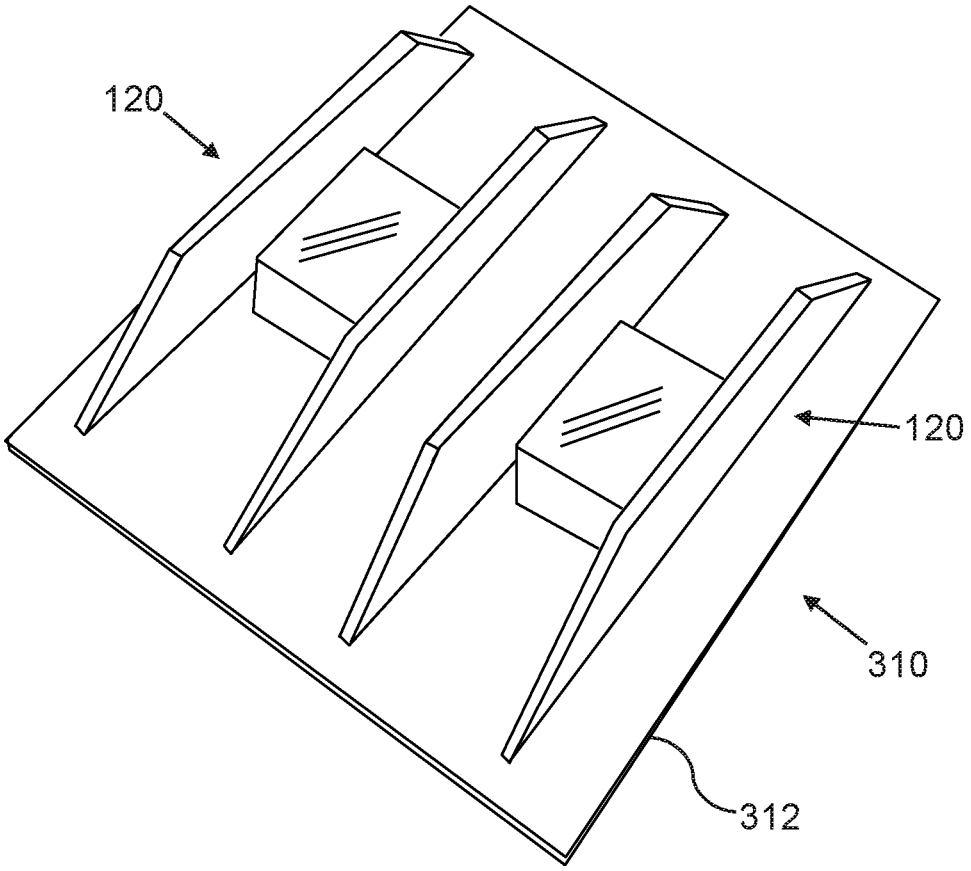
FIG. 3 is a perspective view of a pistol table stand, according to an embodiment of the invention.

In a related embodiment, as shown in FIG. 3, the pistol table stand 310 can be configured with a plurality of pistol holders 120, such as at least two pistol holders 120, mounted on the bottom plate 312. The at least two pistol holders 120 can for example be configured as two, three, four, five, or more pistol holders 120.

In a related embodiment, FIG. 2A-2H show various views of the pistol table stand 110 shown in FIGS. 1A and 1B, which include and illustrate aspects of utility as described herein, and in addition show and describe a new, original, and ornamental design for a pistol table stand 110, wherein:

a) FIG. 2A is a front perspective view of a pistol table stand;

b) FIG. 2B is a rear perspective view thereof;

c) FIG. 2C is a top view thereof;

d) FIG. 2D is a bottom view thereof;

e) FIG. 2E is a front view thereof;

f) FIG. 2F is a rear view thereof;

g) FIG. 2G is a right side view thereof; and h) FIG. 2H is a left side view thereof.

Figure 4A:
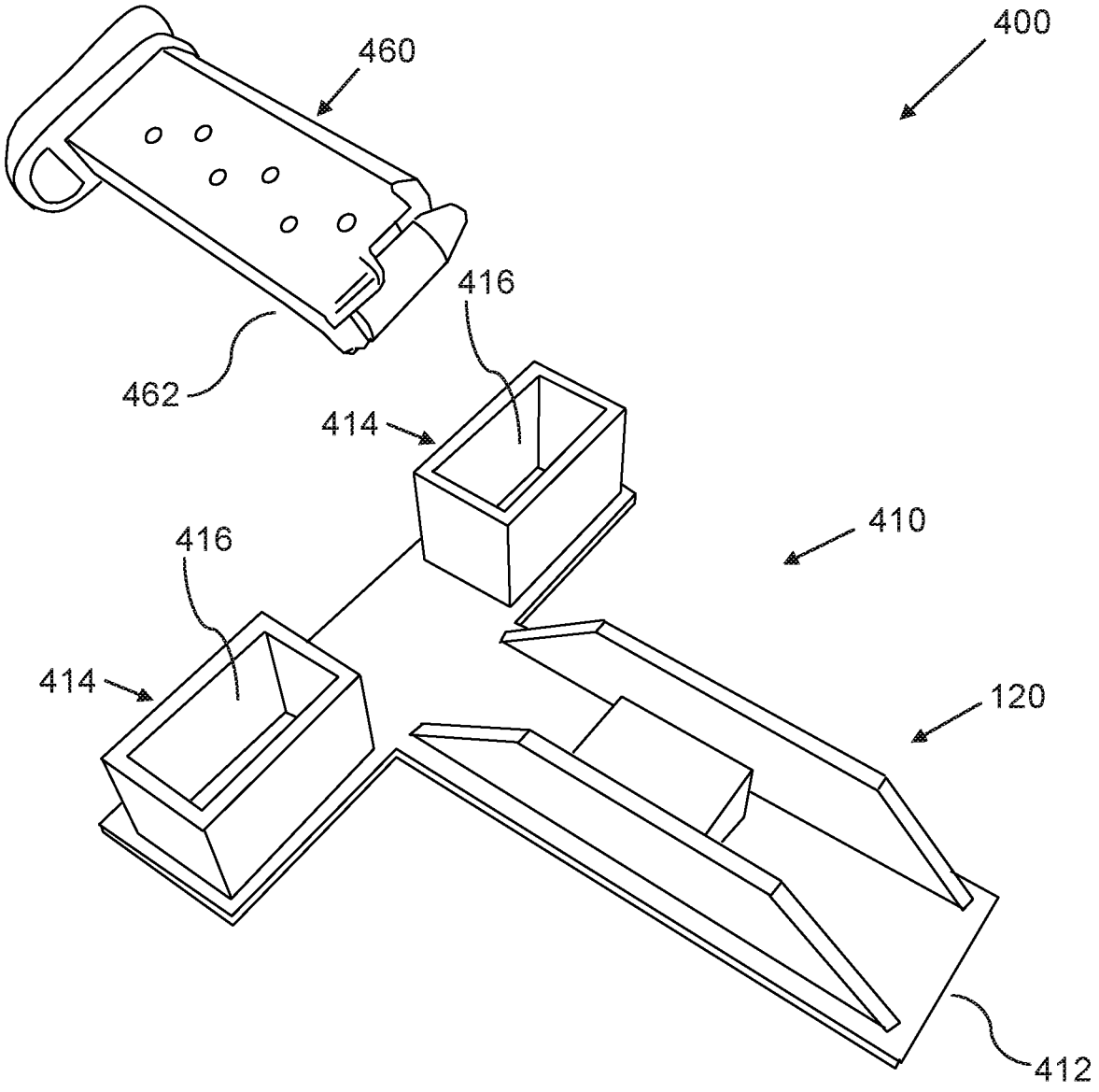
FIG. 4A is a perspective view of a pistol table stand system in a disassembled state, according to an embodiment of the invention.
Figure 4B:
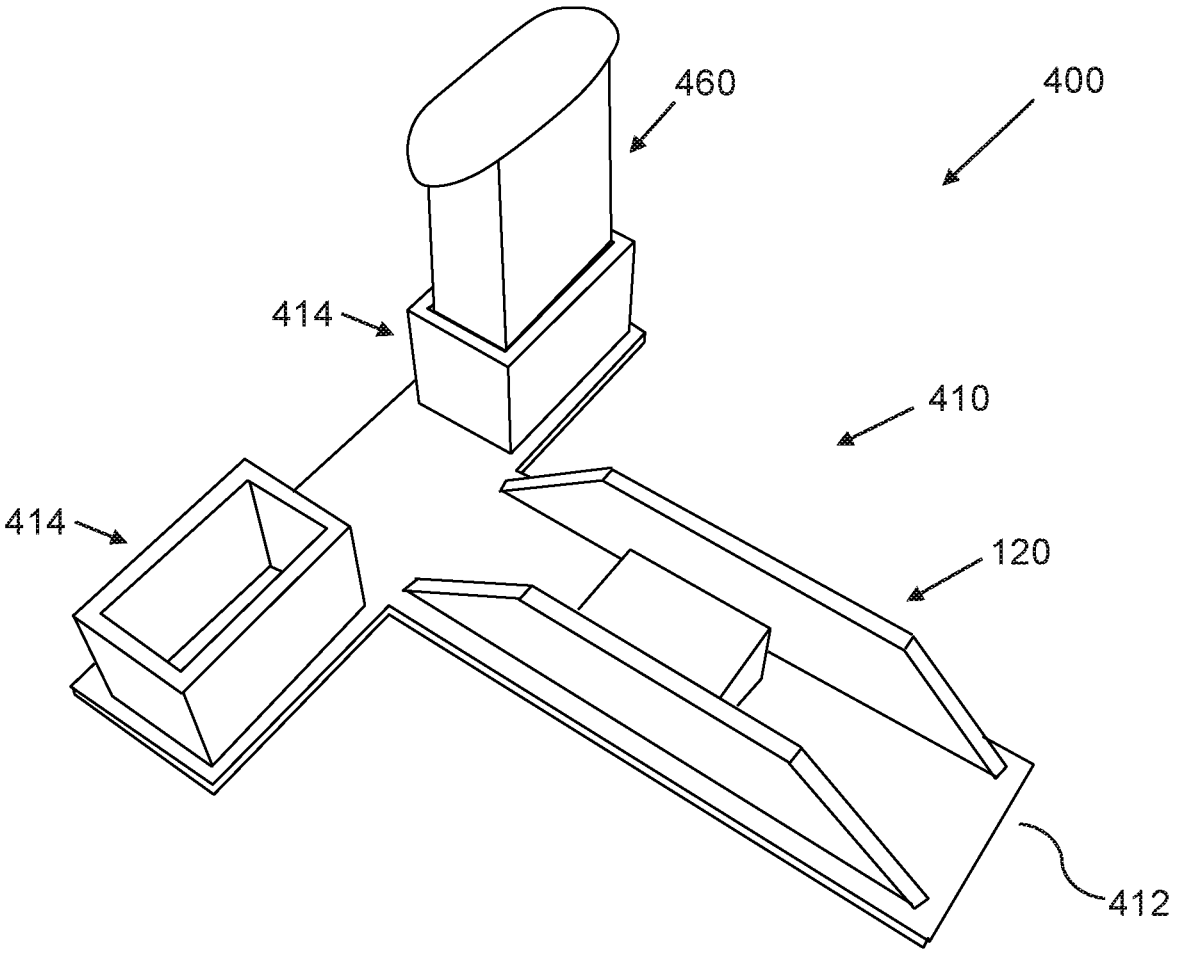
FIG. 4B is a perspective view of a pistol table stand system in an assembled state, according to an embodiment of the invention.

In a related embodiment of a pistol table stand system 400, as shown in FIGS. 4A and 4B, the pistol table stand 410 can be configured with at least one magazine holder 414, which includes a cavity 416, which is accessible via an upper opening; wherein the at least one magazine holder 414 can be connected to an upper side of the bottom plate 412, such that the at least one magazine holder 414 can protrude upward from the bottom plate 412;

wherein the cavity 416 can be configured to accept an inner portion 462 of a pistol magazine 460, such that the pistol magazine 460 can be removably positioned in the at least one magazine holder 414, as shown in FIG. 4B;

In a related embodiment, the cavity 416 can be configured with a shape that matches an inner portion 462 of the pistol magazine 460.

In a related embodiment, as shown in FIGS. 4A and 4B, the pistol table stand 410 can be configured with a plurality of magazine holders 414, such as at least two magazine holders 414.

Here has thus been described a multitude of embodiments of the pistol table stand 110 310 410 and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A pistol table stand system, comprising:

a) a pistol, comprising an ejection port; and b) a pistol table stand, comprising:

a bottom plate; and at least one pistol holder, comprising:

a holder protrusion, which is connected to an upper side of the bottom plate, such that the holder protrusion protrudes upwards from the bottom plate;

a right side-flange, which is connected to the upper side of the bottom plate, such that the right side-flange protrudes upwards from the bottom plate; and a left side-flange which is connected to the upper side of the bottom plate, such that the left side-flange is parallel to the right side-flange, such that the left side-flange protrudes upwards from the bottom plate;

wherein the holder protrusion is configured to accept the ejection port, such that the holder protrusion protrudes into the ejection port, when the pistol is positioned in an inverted position in the pistol table stand;

wherein the holder protrusion is positioned between the right and left side-flanges;

wherein an opening between the right and left side-flanges is configured to accept the pistol in the inverted position, such that the pistol is stably supported in the inverted position;

whereby the pistol table stand is configured to hold the pistol in the inverted position.

2. The pistol table stand system of claim 1, wherein the holder protrusion is box-shaped with polygonal sides.

3. The pistol table stand system of claim 1, wherein the right and left side-flanges are configured with a trapezoidal shape.

4. The pistol table stand system of claim 1, wherein the right and left side-flanges are each configured with an indentation on inner sides of the right and left side-flanges, to match a shape of outer sides of the pistol.

5. The pistol table stand system of claim 1, wherein the at least one pistol holder comprises at least two pistol holders.

6. The pistol table stand system of claim 1, wherein the pistol further comprises a pistol slide, such that the holder protrusion is configured to block a sliding movement of the pistol slide, when the pistol is positioned in the inverted position in the pistol table stand.

7. A pistol table stand, comprising:

a) a bottom plate; and b) at least one pistol holder, comprising:

a holder protrusion, which is connected to an upper side of the bottom plate, such that the holder protrusion protrudes upwards from the bottom plate;

a right side-flange, which is connected to the upper side of the bottom plate, such that the right side-flange protrudes upwards from the bottom plate; and a left side-flange which is connected to the upper side of the bottom plate, such that the left side-flange is parallel to the right side-flange, such that the left side-flange protrudes upwards from the bottom plate;

wherein the holder protrusion is configured to accept an ejection port of a pistol, such that the holder protrusion protrudes into the ejection port, when the pistol is positioned in an inverted position in the pistol table stand;

wherein the holder protrusion is positioned between the right and left side-flanges;

wherein an opening between the right and left side-flanges is configured to accept the pistol in the inverted position, such that the pistol is stably supported in the inverted position;

whereby the pistol table stand is configured to hold the pistol in the inverted position.

8. The pistol table stand of claim 7, wherein the holder protrusion is box-shaped with polygonal sides.

9. The pistol table stand of claim 7, wherein the holder protrusion is connected to one of the right and left side-flanges.

10. The pistol table stand of claim 7, wherein the right and left side-flanges are configured with a trapezoidal shape.

11. The pistol table stand of claim 7, wherein the right and left side-flanges are each configured with an indentation on inner sides of the right and left side-flanges, to match a shape of outer sides of the pistol.

12. The pistol table stand of claim 7, wherein the at least one pistol holder comprises at least two pistol holders.

13. A pistol table stand, comprising:

a) a bottom plate; and b) at least one pistol holder, comprising:

a right side-flange, which is connected to an upper side of the bottom plate, such that the right side-flange protrudes upwards from the bottom plate;

a left side-flange which is connected to the upper side of the bottom plate, such that the left side-flange is parallel to the right side-flange, such that the left side-flange protrudes upwards from the bottom plate; and a holder protrusion, which is connected to an upper side of the bottom plate, such that the holder protrusion protrudes upwards from the bottom plate;

wherein an opening between the right and left side-flanges is configured to accept a pistol in an inverted position;

wherein the holder protrusion is positioned between the right and left side-flanges;

wherein the holder protrusion is configured to accept an ejection port of the pistol, such that the holder protrusion protrudes into the ejection port, when the pistol is positioned in the inverted position in the pistol table stand;

whereby the pistol table stand is configured to hold the pistol in the inverted position.

14. The pistol table stand of claim 13, wherein the holder protrusion is box-shaped with polygonal sides.

15. The pistol table stand of claim 13, wherein the right and left side-flanges are configured with a trapezoidal shape.

16. The pistol table stand of claim 13, wherein the right and left side-flanges are each configured with an indentation on inner sides of the right and left side-flanges, to match a shape of outer sides of the pistol.

17. The pistol table stand of claim 13, wherein the at least one pistol holder comprises at least two pistol holders.

* * * * *